US010144107B2

(12) United States Patent
Kamireddi et al.

(10) Patent No.: US 10,144,107 B2
(45) Date of Patent: Dec. 4, 2018

(54) ULTRASONIC POLISHING SYSTEMS AND METHODS OF POLISHING BRITTLE COMPONENTS FOR ELECTRONIC DEVICES

(71) Applicant: Apple Inc., Cupertino, CA (US)

(72) Inventors: Srikanth Kamireddi, Cupertino, CA (US); Alexander M. Hoffman, San Jose, CA (US)

(73) Assignee: APPLE INC., Cupertino, CA (US)

( * ) Notice: Subject to any disclaimer, the term of this patent is extended or adjusted under 35 U.S.C. 154(b) by 146 days.

(21) Appl. No.: 15/281,025

(22) Filed: Sep. 29, 2016

(65) Prior Publication Data

US 2017/0087687 A1 Mar. 30, 2017

Related U.S. Application Data

(60) Provisional application No. 62/235,337, filed on Sep. 30, 2015.

(51) Int. Cl.

| | |
|---|---|
| ***B24B 37/07*** | (2012.01) |
| ***B24B 37/04*** | (2012.01) |
| ***B24B 57/02*** | (2006.01) |

(52) U.S. Cl.

CPC ..... *B24B 37/07* (2013.01); *B24B 37/042* (2013.01); *B24B 57/02* (2013.01)

(58) Field of Classification Search

CPC ..... B24B 37/07; B24B 37/042; B24B 57/02
USPC ..... 451/36, 35, 60, 113, 165
See application file for complete search history.

(56) References Cited

U.S. PATENT DOCUMENTS

| | | | | | |
|---|---|---|---|---|---|
| 2,942,383 | A * | 6/1960 | Brown | B23Q 5/22 | 451/14 |
| 3,091,060 | A * | 5/1963 | Giegerich | B24B 1/04 | 408/17 |
| 3,094,814 | A * | 6/1963 | Barke | B24B 1/04 | 310/26 |
| 3,131,515 | A * | 5/1964 | Mason | B06B 3/02 | 228/1.1 |
| 3,453,097 | A | 7/1969 | Hafner | | |
| 3,535,159 | A * | 10/1970 | Shiro | B08B 3/12 | 134/1 |

(Continued)

FOREIGN PATENT DOCUMENTS

| | | |
|---|---|---|
| CN | 1976778 | 6/2007 |
| CN | 1978167 | 6/2007 |

(Continued)

*Primary Examiner* — George Nguyen
(74) *Attorney, Agent, or Firm* — Dorsey & Whitney LLP

(57) ABSTRACT

Ultrasonic polishing systems and methods of polishing brittle components for electronic devices using ultrasonic polishing systems are disclosed. The ultrasonic polishing system may include an ultrasonic driver and a polishing head operatively coupled to the ultrasonic driver. The ultrasonic drive may have a surface shape that corresponds to a non-planar feature formed in the brittle component. The ultrasonic polishing system may also include an abrasive slurry configured to be disposed between the non-planar feature of the brittle component and the polishing head. The ultrasonic driver may be configured to displace the polishing head toward and away from the non-planar feature formed in the brittle component.

20 Claims, 13 Drawing Sheets

(56) References Cited

U.S. PATENT DOCUMENTS 3,699,719 A * 10/1972 Rozdilsky ..... B24B 1/04 451/165
3,848,363 A * 11/1974 Lovness ..... B24B 31/102 241/1
3,855,441 A * 12/1974 Kimmelmann ..... B23K 9/00 219/68
3,885,943 A 5/1975 Chui
4,122,602 A * 10/1978 Sastri ..... B24B 1/04 30/346.5
4,343,111 A * 8/1982 Inoue ..... B24B 1/04 219/69.2
4,467,168 A 8/1984 Morgan
4,524,543 A * 6/1985 Inoue ..... B23Q 15/12 451/124
4,682,003 A 7/1987 Minakawa
4,806,731 A 2/1989 Bragard et al.
5,185,957 A * 2/1993 Mizuguchi ..... B24B 1/005 451/11
5,187,899 A * 2/1993 Rhoades ..... B24B 1/04 451/165
5,230,182 A * 7/1993 Daniell ..... B24B 13/00 451/165
5,303,510 A * 4/1994 Calkins ..... B23Q 5/027 451/165
5,384,989 A * 1/1995 Shibano ..... B24B 1/04 451/104
5,404,680 A * 4/1995 Mizuguchi ..... B23Q 1/34 451/1
5,776,355 A 7/1998 Martin et al.
5,857,901 A * 1/1999 LaPoint ..... B24B 31/003 451/113
5,957,753 A * 9/1999 Komanduri ..... B24B 1/005 451/113
6,198,070 B1 3/2001 Nakayama et al.
6,376,797 B1 4/2002 Piwczyk et al.
6,413,619 B1 7/2002 Hamada et al.
6,544,110 B2 * 4/2003 Gilmore ..... B24B 31/116 451/106
6,562,698 B2 5/2003 Manor
6,580,054 B1 6/2003 Liu et al.
6,612,906 B2 * 9/2003 Benderly ..... B24B 1/04 451/165
6,670,571 B2 12/2003 Dance et al.
6,746,724 B1 6/2004 Robertson et al.
6,899,798 B2 5/2005 Weldon et al.
7,208,401 B2 4/2007 Nelson et al.
7,512,297 B2 3/2009 Farah
7,514,291 B2 4/2009 Akram
7,664,469 B2 2/2010 Hutchison
7,741,579 B2 6/2010 Lambert et al.
7,803,451 B2 9/2010 Lee et al.
7,838,796 B2 11/2010 Furui
7,966,785 B2 6/2011 Zadesky et al.
9,120,179 B2 9/2015 Richter et al.
9,844,833 B2 12/2017 Li et al.
2007/0132153 A1 * 6/2007 Aiyer ..... B24B 1/005 264/430
2007/0284785 A1 12/2007 Hoekstra
2009/0017732 A1 * 1/2009 Curodeau ..... B24B 1/04 451/56
2009/0275157 A1 * 11/2009 Winberg ..... H01L 33/20 438/29
2009/0275266 A1 * 11/2009 Winberg ..... H01L 33/58 451/36
2011/0003535 A1 * 1/2011 Perez-Duarte ..... B24B 1/00 451/36
2011/0183580 A1 * 7/2011 Kenney ..... B24B 1/04 451/28
2012/0328905 A1 12/2012 Guo et al.

FOREIGN PATENT DOCUMENTS

JP 2001210905 8/2001
JP 2010239157 10/2010
TW 422751 2/2001
TW M438642 10/2012
WO WO2006038152 4/2006
WO WO2011037167 3/2011

* cited by examiner

ULTRASONIC POLISHING SYSTEMS AND METHODS OF POLISHING BRITTLE COMPONENTS FOR ELECTRONIC DEVICES

CROSS-REFERENCE TO RELATED APPLICATION

This application is a nonprovisional patent application of and claims the benefit of U.S. Provisional Patent Application No. 62/235,337, filed Sep. 30, 2015 and titled "Ultrasonic Polishing Systems and Methods of Polishing Brittle Components for Electronic Devices," the disclosure of which is hereby incorporated herein by reference in its entirety.

FIELD

The disclosure relates generally to polishing brittle components and more particularly to systems and methods of polishing brittle components for electronic devices using an ultrasonic polishing system.

BACKGROUND

Electronic devices continue to become more prevalent in day-to-day activities. For example, smart phones, tablet computers and electronic devices continue to grow in popularity, and provide everyday personal and business functions to its users. These electronic devices may include a display utilized by the user to interact (e.g., through input/output operations) with the electronic devices and/or receive information therefrom. The display is typically protected by a cover glass, which prevents the display from being damaged during use of the electronic device and/or during undesirable shock events (e.g., drops) which the electronic device may experience in day-to-day use.

Conventionally, cover glass is made from reinforced or modified glass. To improve durability, the cover glass can be formed from harder ceramic materials. However, due to the hardness of some ceramic materials, surface finishing operations, such as polishing, may be challenging. Polishing may be particularly difficult if the ceramic component includes non-planar surfaces or features.

SUMMARY

An ultrasonic polishing system for polishing a non-planar feature formed in a brittle component is disclosed. The ultrasonic polishing system comprises an ultrasonic driver and a polishing head operatively coupled to the ultrasonic driver. The ultrasonic drive has a surface shape that corresponds to the non-planar feature formed in the brittle component. The ultrasonic polishing system also comprises an abrasive slurry configured to be disposed between the non-planar feature of the brittle component and the polishing head. The ultrasonic driver is configured to displace the polishing head toward and away from the non-planar feature formed in the brittle component.

A method for polishing a non-planar feature of a brittle component is disclosed. The method comprises positioning a polishing head adjacent the non-planar feature of the brittle component. The brittle component at least partially submerged in an abrasive slurry disposed within a housing. The method also comprises moving, at an ultrasonic frequency, at least one of the housing or the polishing head in at least one of a first direction, and a second direction, perpendicular to the first direction. Additionally, in response to moving at least one of the housing and the polishing head, the method also comprises displacing the abrasive slurry to abrade and polish the non-planar feature of the brittle component. The polishing head comprises a surface shape that corresponds to the non-planar feature of the brittle component.

An ultrasonic polishing system is disclosed. The ultrasonic polishing system comprises a housing for receiving a brittle component comprising a non-planar feature, and a polishing head positioned within the housing. The polishing head having a surface shape that corresponds to the non-planar feature formed in the brittle component. The ultrasonic polishing system also comprises an abrasive slurry positioned within the housing. The abrasive slurry comprises a solid abrasive material suspended in a liquid. Additionally, the ultrasonic polishing system comprises an ultrasonic driver configured to move at least one of the housing or the polishing head at an ultrasonic frequency to polish the non-planar feature of the brittle component using the abrasive slurry.

BRIEF DESCRIPTION OF THE DRAWINGS

The disclosure will be readily understood by the following detailed description in conjunction with the accompanying drawings, wherein like reference numerals designate like structural elements.

DETAILED DESCRIPTION

Figure 1:
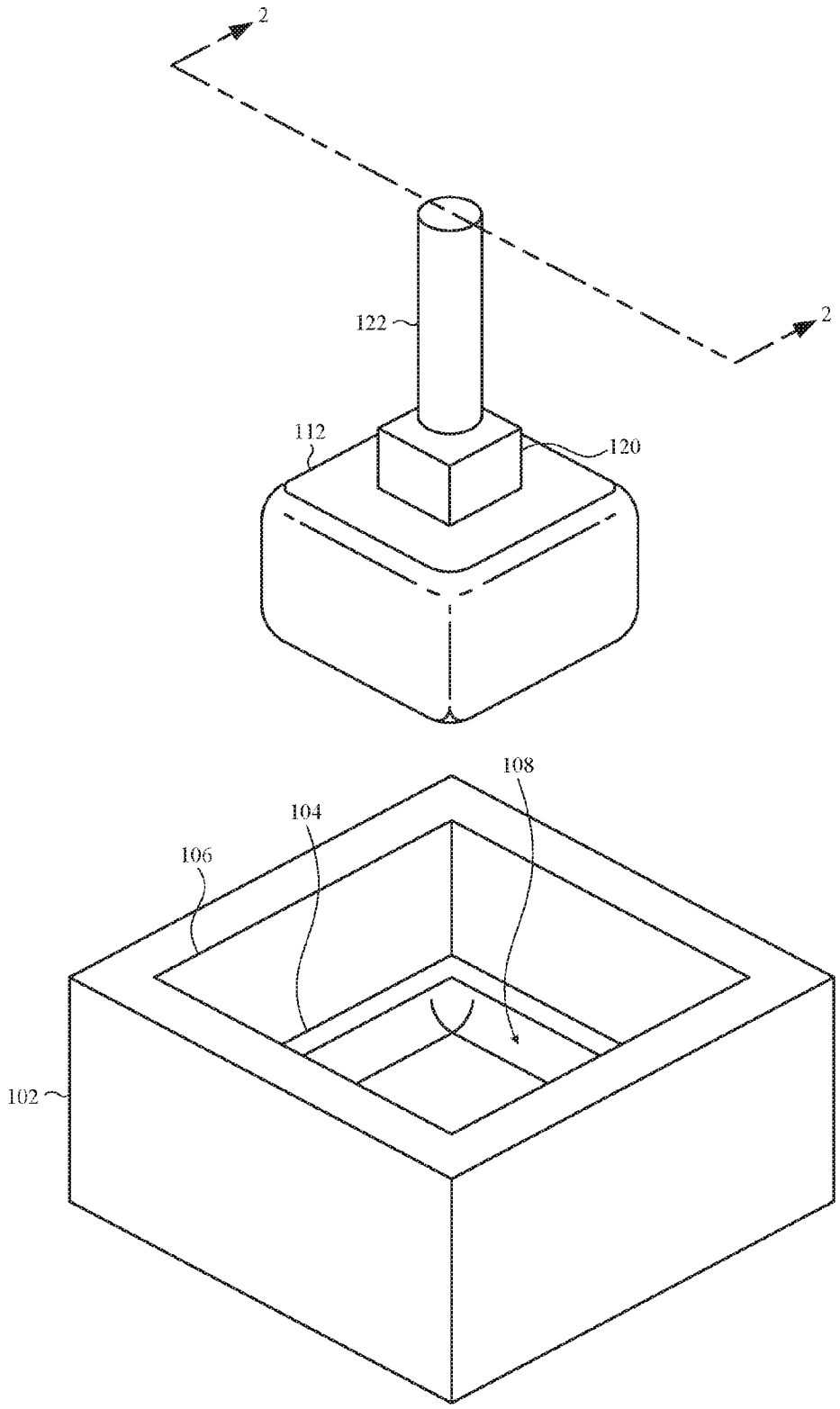
FIG. 1 shows an ultrasonic polishing system used to polish a non-planar feature of a brittle component, according to embodiments.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates generally to polishing brittle components and more particularly to systems and methods of polishing brittle components for electronic devices using an ultrasonic polishing system.

Some example embodiments are directed to a cover or component that is formed from a brittle material, such as sapphire, zirconia, or other ceramic material. Prior to being implemented within the electronic devices, the component formed from the brittle material may undergo a polishing process to improve transparency and/or cosmetic appearance. Flat surfaces of the component may be polished to a desired finish without difficulty. However, polishing intricate or complex geometries may be difficult. For example, if the component includes a cavity or recess, conventional polishing techniques and processes may fall short of providing an adequate or desired polish. In particular, portions of the cavity or recess may have an uneven polish due to functional limitations (e.g., movement, flexibility, compliancy, and so on) of polishing heads (e.g., brushes, bristles, pads and so on) used to polish the cavity.

Some example embodiments are directed to an ultrasonic polishing system that includes a polishing head positioned within a housing containing an abrasive slurry and a brittle component formed from a brittle material, submerged in the abrasive slurry. The polishing head and/or the housing are coupled to an ultrasonic driver configured to move the polishing head and/or the brittle component to polish a non-planar feature of the brittle component. The ultrasonic driver moves the polishing head and/or the housing to ensure that the entire non-planar feature of the brittle material is evenly and consistently polished.

The polishing head is designed to match the geometry or shape of the non-planar feature of the brittle component to ensure consistent polishing of the brittle material. Specifically, the polishing head has an exterior contact surface with a shape that corresponds to the shape of the non-planar feature of the brittle component. The shape of the exterior contact surface of the polishing head can be a negative of the non-planar feature and/or is a corresponding male/female geometry or shape of the non-planar feature. By including an corresponding shape of the non-planar feature, the polishing head of the ultrasonic polishing system may help to ensure all portions of the non-planar feature are exposed to the polishing head and/or the abrasive polishing slurry evenly, which may result in a consistent polish on the brittle component.

The abrasive slurry continuously passes over the non-planar feature of the brittle component during the polishing process to polish the non-planar feature. That is, the motion of the polishing head and/or the housing containing the brittle component may ensure that the abrasive slurry continuously moves, passes-over and/or contacts the non-planar feature. The abrasive properties of the slurry, along with the continuous movement of the abrasive slurry result in the non-planar feature of the brittle component being polished to a desired finish.

These and other embodiments are discussed below with reference to FIGS. 1-12. However, those skilled in the art will readily appreciate that the detailed description given herein with respect to these Figures is for explanatory purposes only and should not be construed as limiting.

FIG. 1 shows an ultrasonic polishing system. Ultrasonic polishing system 100 (hereafter, "polishing system 100") includes various components for polishing non-planar features of materials and/or components. That is, and as discussed herein in detail, polishing system 100 may include various components configured to polish non-planar features, geometries and/or features formed in materials and/or components, such that the non-planar features, geometries and/or features have an even surface finish or polish throughout. The terms "non-planar feature or geometries" as discussed herein may refer to portions and/or surfaces of a material or component that are not substantially flat, even, planar or the like. Additionally, non-planar feature or geometries may refer to surfaces or portions of a material or component that includes non-linear transitions portions formed within the material or structure. FIG. 1 depicts a non-planar feature including a cavity formed within a material, where the cavity includes a base portion, sidewall portion and a curved transition portion positioned between the base portion and the sidewall portion.

Polishing system 100 includes a housing 102 for receiving a brittle component 104. In an example embodiment shown in FIG. 1, housing 102 of polishing system 100 is substantially fixed and/or does not move when performing the polishing process on the brittle component 104. In additional example embodiments discussed herein, housing 102 may be configured to move in at least one direction during the polishing process. As shown in FIG. 1, housing 102 has an opening 106 for receiving brittle component 104 and distinct components of polishing system 100 discussed herein. Housing 102 may be formed from any suitable rigid material that can withstand the exposure to the ultrasonic operational parameters of polishing system 100, discussed herein, for polishing brittle component 104.

Brittle component 104 is positioned within housing 102, and may rest on a bottom, interior surface of housing 102. In a non-limiting example shown in FIG. 1, the weight of brittle component 104, the polishing process and/or distinct components of polishing system 100 keep brittle component 104 stationary within housing 102 during the polishing process. In other non-limiting examples (see, FIG. 6) additional layers and/or inserts can be positioned within housing 102 and may substantially surround brittle component 104 to prevent brittle component 104 from moving within housing 102 during the polishing process. Brittle component 104 is formed from a variety of materials that have brittle characteristics or properties. In non-limiting examples, brittle component 104 is formed from glass or ceramics, including, for example, zirconia or sapphire. Additionally, and as discussed herein, brittle component 104 can be utilized within an electronic device, and specifically, brittle component 104 can be used to form a housing and/or a cover for an electronic device.

As shown in FIG. 1, brittle component 104 includes a non-planar feature or geometry 108 (hereafter, "non-planar feature 108") formed on at least one surface. In the non-limiting example, a cavity is formed within brittle component 104. Non-planar feature 108 of brittle component 104 includes a curved transition portion between a flat or planar base portion and sidewalls of the cavity formed within brittle component 104. As discussed herein, non-planar feature 108 is polished using polishing system 100.

Polishing system 100 also includes abrasive polishing slurry (see, FIGS. 2A and 2B; 210) positioned within housing 102. The abrasive slurry is omitted from FIG. 1 for clarity purposes, but will now be discussed in detail and shown and discussed herein with respect to FIGS. 2A and 2B (e.g., abrasive slurry 210). The abrasive slurry substantially surrounds brittle component 104 within housing 102. That is, brittle component 104 is submerged in abrasive slurry positioned within in housing 102. During the polishing process, the abrasive slurry may continuously flow over non-planar feature 108 of brittle component 104 to polish non-planar feature 108.

The abrasive slurry may include a solid abrasive material suspended in a liquid. In some cases, the solid abrasive material is made from a deformable or malleable base material and a substantially tough, hard or solid abrasive material encrusted or impregnated within the base material. The solid abrasive material encrusted or impregnated within the base material may provide the abrasive characteristics for the abrasive slurry that are necessary for polishing non-planar feature 108 of brittle component 104 during a polishing process. In non-limiting examples, the abrasive slurry is a diamond encrusted resin-based material or a diamond impregnated elastomer resin material. The specific material or compositional characteristics of the abrasive slurry, such as the composition of the solid abrasive material or the grain size of the solid abrasive material encrusted or impregnated within the base material, are dependent on various aspects of polishing system 100 and/or brittle component 104. In non-limiting examples, material or compositional characteristics of abrasive slurry are dependent, at least in part, on the type of material forming brittle component 104, the geometry of non-planar feature 108 to be polished, the desired polish or finish characteristics for non-planar feature 108, physical and material characteristics for a polishing component of the polishing system 100, and so on. The solid abrasive material of the abrasive slurry has a hardness that is greater than the hardness of the brittle material forming brittle component 104 in order to abrade and/or polish non-planar feature 108, as discussed below in detail.

Polishing system 100 also includes a polishing head 112 positioned within the housing 102. During the polishing process discussed herein, polishing head 112 is positioned within housing 102 adjacent non-planar feature 108 of brittle component 104. In a non-limiting example, and as discussed herein, polishing head 112 is displaced toward and away from non-planar feature 108 formed in brittle component 104. Specifically, during the polishing process, polishing head 112 is continuously displaced with respect to brittle component 104, such that the polishing head 112 is alternated between being positioned a predetermined, maximum distance ($D_{MAX}$) (see, FIG. 2A) and a predetermined, minimum distance ($D_{MIN}$) (see, FIG. 2B) from non-planar feature 108 of brittle component 104. As discussed herein, the distances in which polishing head 112 is displaced is dependent on, at least in part, the grain size of the solid abrasive material of the abrasive slurry. Additionally as discussed herein, the displacement of polishing head 112 aids in flowing of the abrasive slurry over non-planar feature 108 to polish the same.

Polishing head 112 can be formed from a variety of materials for polishing non-planar feature 108. The material used to form polishing head 112 is dependent, at least in part, on the material or composition of brittle component 104 undergoing the polishing process discussed herein. Additionally, the material forming polishing head 112 is dependent, at least in part, on the material or composition of the base material and/or the solid abrasive material forming the abrasive slurry.

In a non-limiting example, polishing head 112 is formed from a substantially rigid material. The rigid material forming polishing head 112 includes desired material and/or physical characteristics that depend, at least in part, on the composition of brittle component 104, the composition of the abrasive slurry and/or the operational parameters of the polishing process discussed herein. In non-limiting examples, the rigid material is substantially dense, substantially tough (e.g., strength, ductility and so on), and/or substantially hard. Having the desired material and/or physical characteristics discussed herein ensures polishing head 112 formed from the rigid material can withstand, for example, the frequency of movement required for polishing non-planar feature 108 of brittle component 104, and/or provide enough durability to polish brittle component 104 that may be formed from a substantially hard material (e.g., sapphire) as well. In non-limiting examples, polishing head 112 is formed from stainless steel, titanium, carbon steel and any other suitable material having similar and/or the desired material and/or physical characteristics discussed herein.

In another non-limiting example, polishing head 112 is formed from a substantially compliant material. Similar to the example including the rigid material discussed above, compliant material forming polishing head 112 includes desired material and/or physical characteristics that depend, at least in part, on the composition of brittle component 104, the composition of the abrasive slurry and/or the operational parameters of the polishing process discussed herein. However, the same properties or characteristics of brittle component 104, abrasive slurry and/or the operational parameters of the polishing process may influence the desired material and/or physical characteristics of the compliant material differently. In non-limiting examples, the compliant material is substantially elastic, substantially dense, substantially resilient, and/or has substantial compressive strength. With comparison to the rigid material, which may require the polishing head 112 to be substantially hard, polishing head 112 formed from the complaint material may be substantially elastic and/or flexible. The elasticity and/or flexibility of polishing head 112 ensures that the abrasive slurry is pushed against non-planar feature 108 with enough pressure and/or with enough volume during the polishing process discussed herein to polish brittle component 104 to a desired finish. In non-limiting examples, polishing head 112 is formed from rubber, neoprene, silicone, polyurethane, and/or any other elastomer or substantially compliant material having similar and/or the desired material and/or physical characteristics discussed herein.

Polishing head 112 of polishing system 100 has an exterior contact surface 118 positioned within housing 102, adjacent brittle component 104. Exterior contact surface 118 has a surface shape that corresponds to the shape of non-planar feature 108 of brittle component 104. As shown in FIG. 1, the surface shape of exterior contact surface 118 substantially corresponds (e.g., male-to-female, positive-tonegative) to the shape of non-planar feature 108. In the non-limiting example where non-planar feature 108 is curved transition portion of the cavity formed in brittle component 104 (e.g., female portion), exterior contact surface 118 of polishing head 112 has a surface shape (e.g., male portion) corresponding to the non-planar feature. Additionally, the surface shape of exterior contact surface 118 of polishing head 112 includes a shape corresponding to other portions of the cavity formed in brittle component 104, such as for example, a base portion, and a sidewall portion positioned adjacent non-planar feature 108 (e.g., curved transition portion) of brittle component 104. Polishing head 112, and specifically exterior contact surface 118, is dimensionally (e.g., width) smaller than the cavity formed in brittle component 104 including non-planar feature 108. The smaller dimension or size of polishing head 112 provides enough space or distance between polishing head 112 and brittle component 104 to allow abrasive slurry to pass between polishing head 112 and brittle component 104 during the polishing processes discussed herein.

Polishing system 100 also includes ultrasonic driver 120. Ultrasonic driver 120 is operatively coupled to polishing head 112 in a non-limiting example shown in FIG. 1. However, and as discussed herein, ultrasonic driver 120 may be coupled to distinct and/or multiple components of polishing system 100. Ultrasonic driver 120 is configured as any suitable apparatus or component that is capable of oscillating polishing head 112 at ultrasonic pulses, frequencies, amplitudes and the like, when polishing brittle component 104. It is understood that ultrasonic driver 120 includes additional components, such as a transducer, a control system and a power system, for example, to move polishing head 112 in polishing system 100.

Polishing system 100 can also include an actuating gantry 122 coupled to ultrasonic driver 120 and/or polishing head 112. Although only a single shaft or support is shown for gantry 122, it is understood that gantry 122 is configured as any suitable gantry, stage, or track system configured to move polishing head 112, and additional components of polishing system 100 discussed herein, in at least one direction. In a non-limiting example, gantry 122 is configured to move polishing head 112 in a first or axial direction ($D_A$), as indicated in FIG. 1. As discussed herein, the distance between polishing head 112 and brittle component 104 is repeatedly varied in an axial direction ($D_A$) during the polishing process in order to polish non-planar feature 108. As such, and in the example shown in FIG. 1, ultrasonic gantry 122 is configured to move polishing head 112 in the axial direction ($D_A$).

Additionally, gantry 122 is configured to move polishing head 112 in a second or transversal direction ($D_T$), perpendicular to the axial direction ($D_A$), as shown in FIG. 1. In a non-limiting example, gantry 122 can move polishing head 112 in the transversal direction ($D_T$) in conjunction with moving polishing head 112 in the axial direction ($D_A$). In another non-limiting example, and as discussed herein, gantry 122 can move polishing head 112 only in the transversal direction ($D_T$), so long as other components of polishing system 100 can repeatedly vary the distance between polishing head 112 and brittle component 104 in an axial direction ($D_A$) during the polishing process. Polishing head 112 is moved in the transversal direction ($D_T$) by gantry 122 during the polishing process to ensure all portions of non-planar feature 108 of brittle component 104 is polished.

Figure 2A:
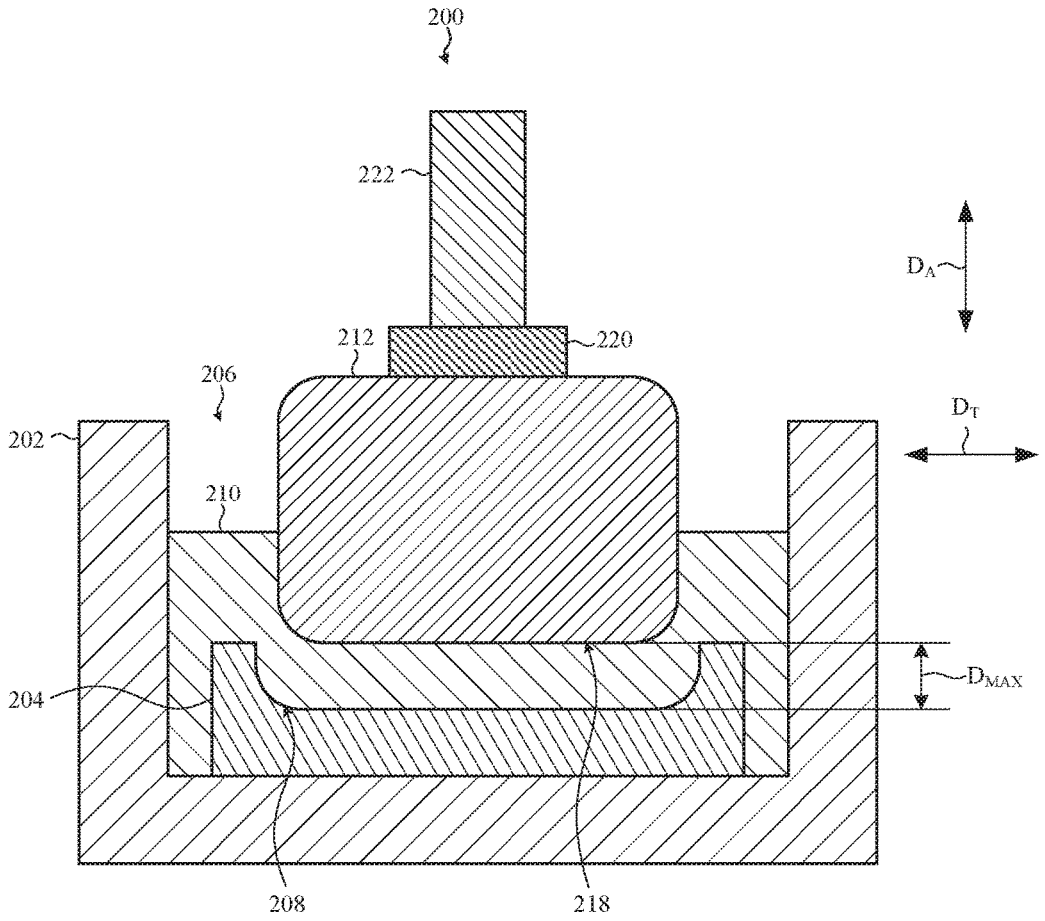
FIG. 2A shows a cross-section view of the ultrasonic polishing system and the brittle component taken along line 2-2 of FIG. 1, according to embodiments. A polishing head of the ultrasonic polishing system is positioned in a first position.
Figure 2B:
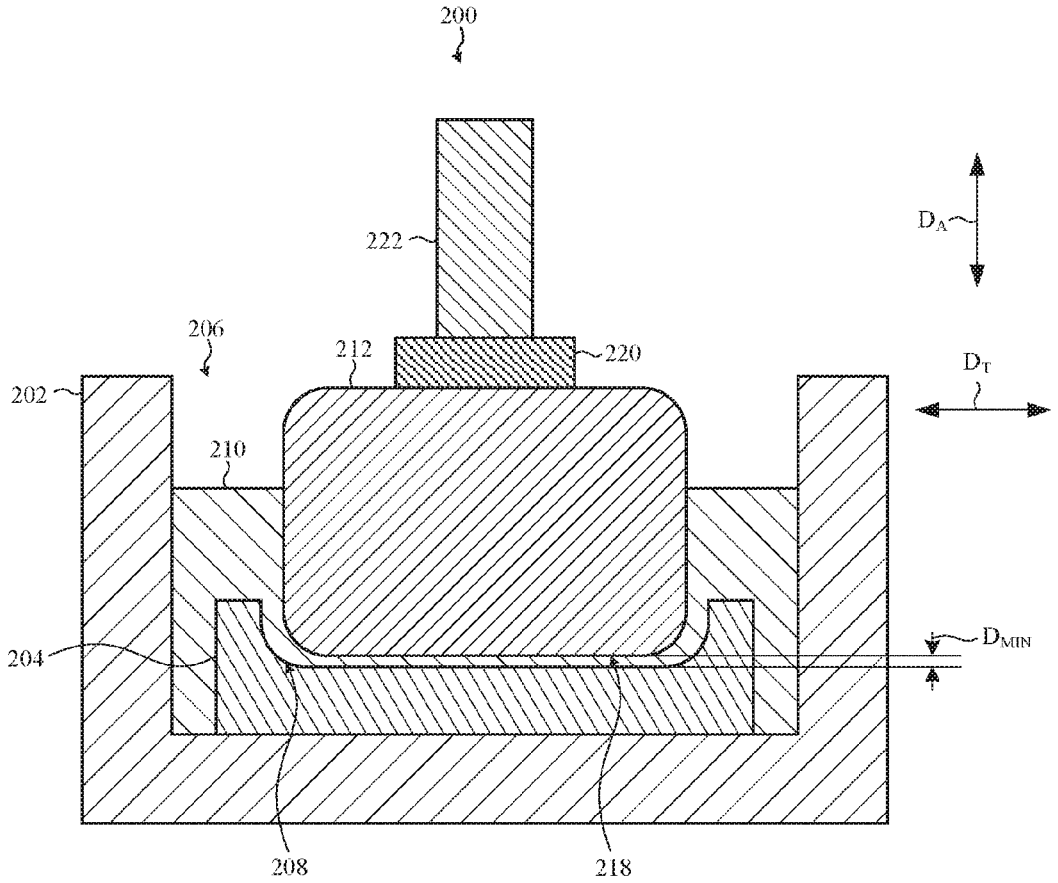
FIG. 2B shows a cross-section view of the ultrasonic polishing system and the brittle component taken along line 2-2 of FIG. 1, according to embodiments. A polishing head of the ultrasonic polishing system is positioned in a second position.

The polishing process will now be discussed briefly with respect to FIGS. 2A, 2B and 3. FIGS. 2A and 2B show polishing system 200, substantially identical to polishing system 100 depicted in FIG. 1. It is understood that similarly numbered and/or named components may function in a substantially similar fashion. Redundant explanation of these components have been omitted for clarity.

As shown in FIG. 2A, the polishing process of non-planar feature 208 of brittle component 204 has begun. In the non-limiting example, polishing head 212 is positioned within housing 202 and above brittle component 204. Specifically, gantry 222 has moved polishing head 212 in an axial direction ($D_A$) away from non-planar feature 208. In the example shown in FIG. 2A, polishing head 212 is moved in the axial direction ($D_A$) a predetermined, maximum distance ($D_{MAX}$) from brittle component 204. The predetermined, maximum distance ($D_{MAX}$) is dependent, at least in part, on the material and/or compositional properties of abrasive slurry 210, the material characteristics of brittle component 204 and/or the desired polish and/or finish for non-planar feature 208 of brittle component 204. In a non-limiting example, predetermined, maximum distance ($D_{MAX}$) between polishing head 212 and brittle component 204 is a distance greater than the grain size of the solid abrasive material of abrasive slurry 210, and specifically is approximately 150% of the grain size of the solid abrasive material. In the non-limiting example, abrasive slurry 210 is a diamond encrusted resin-based material, and the diamonds formed therein have a grain size of approximately 20 microns. As such, the predetermined, maximum distance ($D_{MAX}$) between polishing head 212 and brittle component 204 is within a range of approximately 25 microns and 45 microns, and may be approximately 30 microns. Predetermined, maximum distance ($D_{MAX}$) is greater than the grain size of the solid abrasive material to ensure abrasive slurry 210 may move freely and/or without restriction between polishing head 212 and non-planar feature 208 when gantry 222 moves polishing head 212 to the predetermined, maximum distance ($D_{MAX}$) and ultrasonic driver 220 pulses polishing head 212. This also results in abrasive slurry 210 flowing over non-planar feature 208 of brittle component 204 to abrade and/or polish non-planar feature 208, as discussed herein.

FIG. 2B shows polishing system 200 in a subsequent configuration than shown in FIG. 2A. Specifically, polishing head 212 system 200 shown in FIG. 2B is in a subsequent position or a position that supersedes moving polishing head 212 to the predetermined, maximum distance ($D_{MAX}$) from brittle component 204. Gantry 222 has moved polishing head 212 in an axial direction ($D_A$) toward non-planar feature 208. In the example shown in FIG. 2B, polishing head 212 is moved in the axial direction toward brittle component 204 to be positioned a predetermined, minimum distance ($D_{MIN}$) from non-planar feature 208. Similar to the predetermined, maximum distance ($D_{MAX}$), the predetermined, minimum distance ($D_{MIN}$) is also dependent, at least in part, on the material and/or compositional properties of abrasive slurry 210, the material characteristics of brittle component 204 and/or the desired polish and/or finish for non-planar feature 208 of brittle component 204. In a non-limiting example, predetermined, minimum distance ($D_{MIN}$) for polishing head 212 is a distance equal to, or slightly less than, the grain size of the solid abrasive material of abrasive slurry 210. Continuing the example above with respect to the diamond encrusted resin-based material, the predetermined, minimum distance ($D_{MIN}$) between polishing head 212 and brittle component 204 is 20 microns, or alternatively within a range of approximately 15 microns and 18 microns. Predetermined, minimum distance ($D_{MIN}$) is equal to or less than the grain size of the solid abrasive material forming abrasive slurry 210 to ensure abrasive slurry 210 positioned between polishing head 212 and non-planar feature 208 is pressed into brittle component 204 with an adequate force or pressure to abrade or polish non-planar feature 208. Additionally, predetermined, minimum distance ($D_{MIN}$) is equal to or less than the grain size of the solid abrasive material to ensure at least a portion of abrasive slurry 210 positioned between polishing head 212 and non-planar feature 208 at the predetermined, maximum distance ($D_{MAX}$) (see, FIG. 2A) is moved over non-planar feature 208 and/or away from polishing head 212.

As discussed herein, the distance between polishing head 212 and non-planar feature 208 of brittle component 204 may continuously and/or repeatedly vary. The distance may vary between the predetermined, minimum distance ($D_{MIN}$) and the predetermined, maximum distance ($D_{MAX}$) shown in FIGS. 2A and 2B. In varying the distance between the predetermined, minimum distance ($D_{MIN}$) and the predetermined, maximum distance ($D_{MAX}$), polishing head 212 may continuously force abrasive slurry 210 into non-planar feature 208 (e.g., the predetermined, minimum distance ($D_{MIN}$)) and subsequently allow new and/or additional abrasive slurry 210 to freely flow over brittle component 204 (e.g., the predetermined, maximum distance ($D_{MAX}$)) to polish non-planar feature 208. That is, the displacement of the polishing head 212 via gantry 222 and the ultrasonic movements of polishing head 212 via ultrasonic driver 220 causes abrasive slurry 210 to continuously move, be displaced and/or circulate within housing 202. As a result, as polishing head 212 is moved between the predetermined, minimum distance ($D_{MIN}$) and the predetermined, maximum distance ($D_{MAX}$), new or "fresh" abrasive slurry 210 is positioned between polishing head 212 and brittle component 204. Additionally, abrasive slurry 210 previously positioned between polishing head 212 and brittle component 204 is displaced away from brittle component 204 within housing 202 to make room for new abrasive slurry 210.

Although shown and discussed herein as utilizing a single polishing head 212 within polishing system 200 to polish brittle component 204, it is understood that multiple polishing heads 212 may be utilized in the polishing process. That is, polishing head 212 may be interchanged during the polishing process to repeat the polishing process to achieve distinct polishing characteristics on non-planar feature 208 of brittle component 204. Additionally, materially and/or compositionally distinct abrasive slurries may be used to polish brittle component 204, and may be interchanged and/or disposed within housing 202 during the polishing process discussed herein. Furthermore, once brittle component 204 undergoes the polishing process discussed herein, brittle component 204 can be removed from housing 202 and may undergo additional processing, including additional polishing using polishing pads or brushes.

Figure 3:
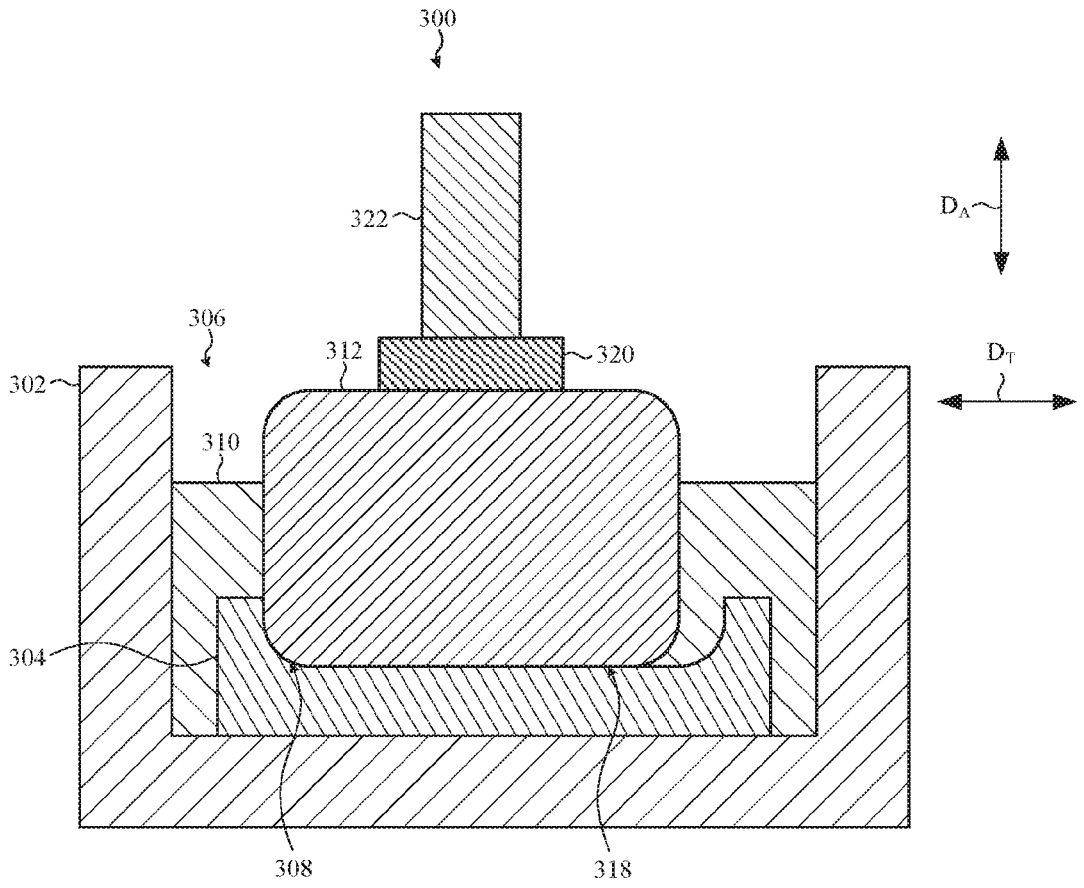
FIG. 3 shows a cross-section view of the ultrasonic polishing system and the brittle component taken along line 2-2 of FIG. 1, according to additional embodiments. A polishing head of the ultrasonic polishing system is positioned in a third position.

FIG. 3 shows a distinct positioning of polishing head 312 of polishing system 300 when performing the polishing process on brittle component 304. As shown in FIG. 3, and as discussed herein in comparison to FIGS. 1-2B, polishing head 312 is moved in a transversal direction ($D_T$). In the non-limiting example, gantry 322 moves polishing head 312 in both the axial direction ($D_A$), as discussed herein with respect to FIGS. 2A and 2B, and the transversal direction ($D_T$), as briefly discussed herein with respect to FIG. 1. Polishing head 312 is moved in the transversal direction ($D_T$) to ensure all portions of brittle component 304 is polished to a desired finish. In the non-limiting example, polishing head 312 may be moved in both the axial direction ($D_A$) and transversal direction ($D_T$) to ensure that abrasive slurry 310 flows over all portions (e.g., side walls, and transition portions) of the cavity formed in brittle component 304, including non-planar feature 308. The combination of moving polishing head 312 in the axial direction ($D_A$) and transversal direction ($D_T$) ensures non-planar feature 308 of brittle component 304 is also adequately polished.

FIG. 3 also shows another non-limiting step in the polishing process for polishing system 300. Specifically, polishing head 312 of polishing system 300 may directly contact non-planar feature 308 of brittle component 304 during the polishing process. As shown in FIG. 3, the predetermined, minimum distance ($D_{MIN}$) (see, FIG. 2B) between polishing head 312 and brittle component 304 may be negligible and/or zero, such that polishing head 312 contacts non-planar feature 308 directly. Where polishing head 312 contacts non-planar feature 308 of brittle component 304 directly, no amount of abrasive slurry 310 passes between polishing head 312 and brittle component 304. In the non-limiting example shown in FIG. 3, brittle component 304 may be polished when polishing head 312 is moved from the predetermined, minimum distance ($D_{MIN}$) to the predetermined, maximum distance ($D_{MAX}$), and vice versa. Additionally, non-planar feature 308 of brittle component 304 may be polished by polishing head 312 directly. That is, the ultrasonic movements of polishing head 312 generated by ultrasonic driver 320, and contacting polishing head 312 directly to brittle component 304 results in non-planar feature 308 being polished by polishing head 312. Additionally, and as discussed herein with respect to FIG. 1, exterior contact surface 318 of polishing head 312 includes a surface shape corresponding to the shape of non-planar feature 308. As such, in the non-limiting example shown in FIG. 3, non-planar feature 308 of brittle component 304 is evenly and consistently contacted by the entirety of exterior contact surface 318 of polishing head 312 when polishing brittle component 304.

Figure 4:
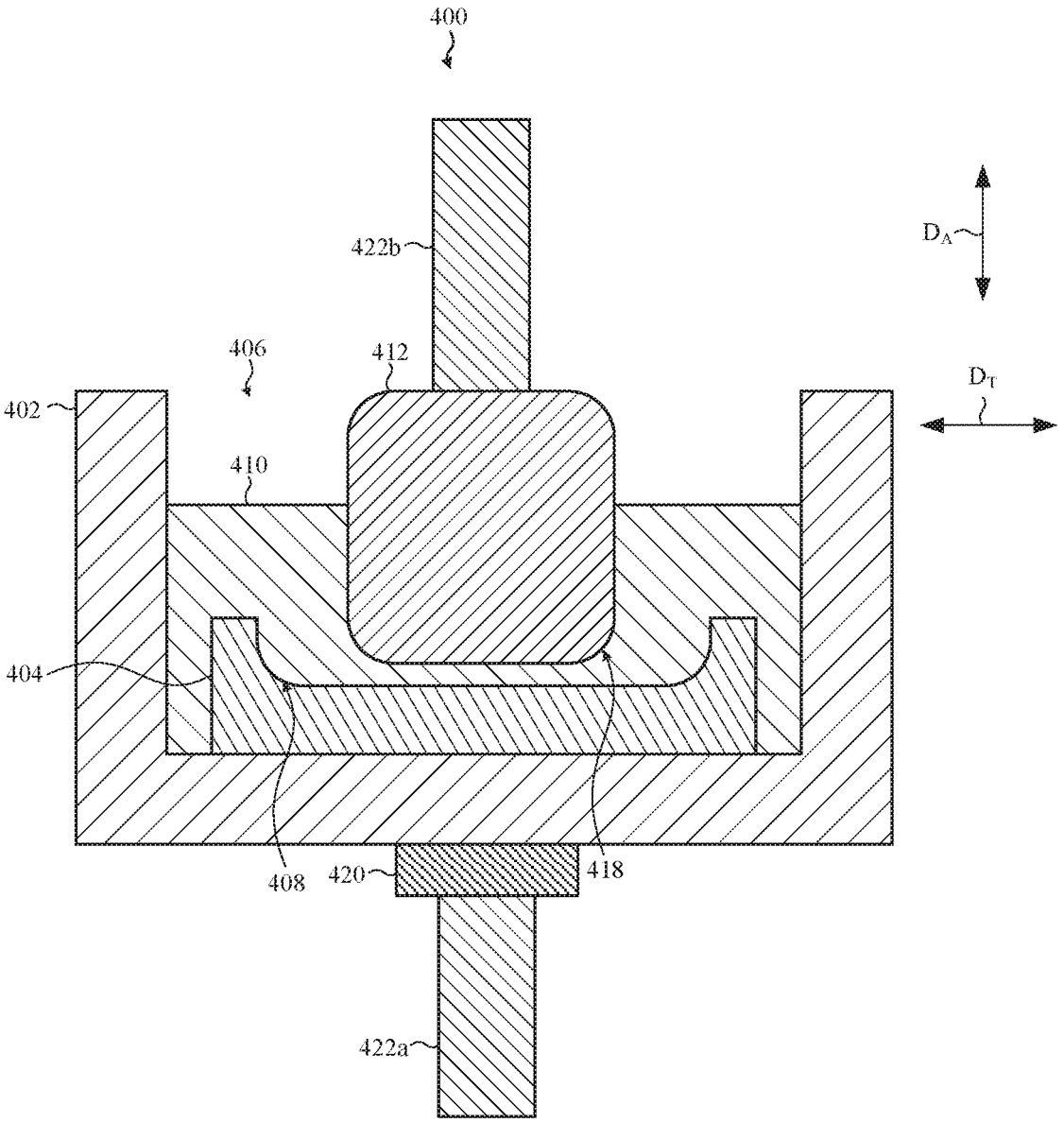
FIG. 4 shows a cross-section view of the ultrasonic polishing system and the brittle component taken along line 2-2 of FIG. 1, according to additional embodiments.

An additional, non-limiting example of polishing system 400 is shown in FIG. 4. As shown in FIG. 4, and with comparison to FIGS. 1-3, polishing head 412 is substantially smaller in size than the cavity formed in brittle component 404 including non-planar feature 408. Although smaller in size, polishing head 412 includes exterior contact surface 418 that has a surface shape that substantially corresponds to the shape of non-planar feature 408, as similarly discussed herein. As a result, polishing head 412 is capable and/or configured to abrade and/or polish brittle component 404, and specifically non-planar feature 408, so long as polishing head 412 and/or housing 402 is moved in both the axial direction and transversal direction; discussed below in detail.

In the non-limiting example shown in FIG. 4, ultrasonic driver 420 and gantry 422*a* of polishing system 400 is coupled to housing 402. Additionally, and as shown in FIG. 4, ultrasonic driver 420 is not coupled to polishing head 412. Rather, polishing head 412 is supported and/or only coupled to gantry 422*b*. Polishing head 412 can be moved in at least one direction (e.g., axial direction, transversal direction) as discussed herein with respect to FIGS. 1-3, or alternatively, polishing head 412 is stationary and/or held rigidly within housing 402 of polishing system 400. In the non-limiting example, ultrasonic driver 420 coupled to housing 402 is configured pulse or ultrasonically move housing 402 containing brittle component 404 and gantry 422*a* coupled to housing 402 is configured to repeatedly move housing 402, and ultimately brittle component 404, as discussed herein. Specifically, gantry 422*a* coupled to housing 402 is configured to move housing 402 and brittle component 404 in an axial direction ($D_A$) toward and away from (stationary) polishing head 412 to polish non-planar feature 408 of brittle component 404 in a similar manner as discussed herein with respect to FIGS. 1-2B. Additionally, gantry 422*a* can also be configured to repeatedly move housing 402 and brittle component 404 in a transversal direction ($D_T$), as discussed herein with respect to FIGS. 1 and 3.

Figure 5:
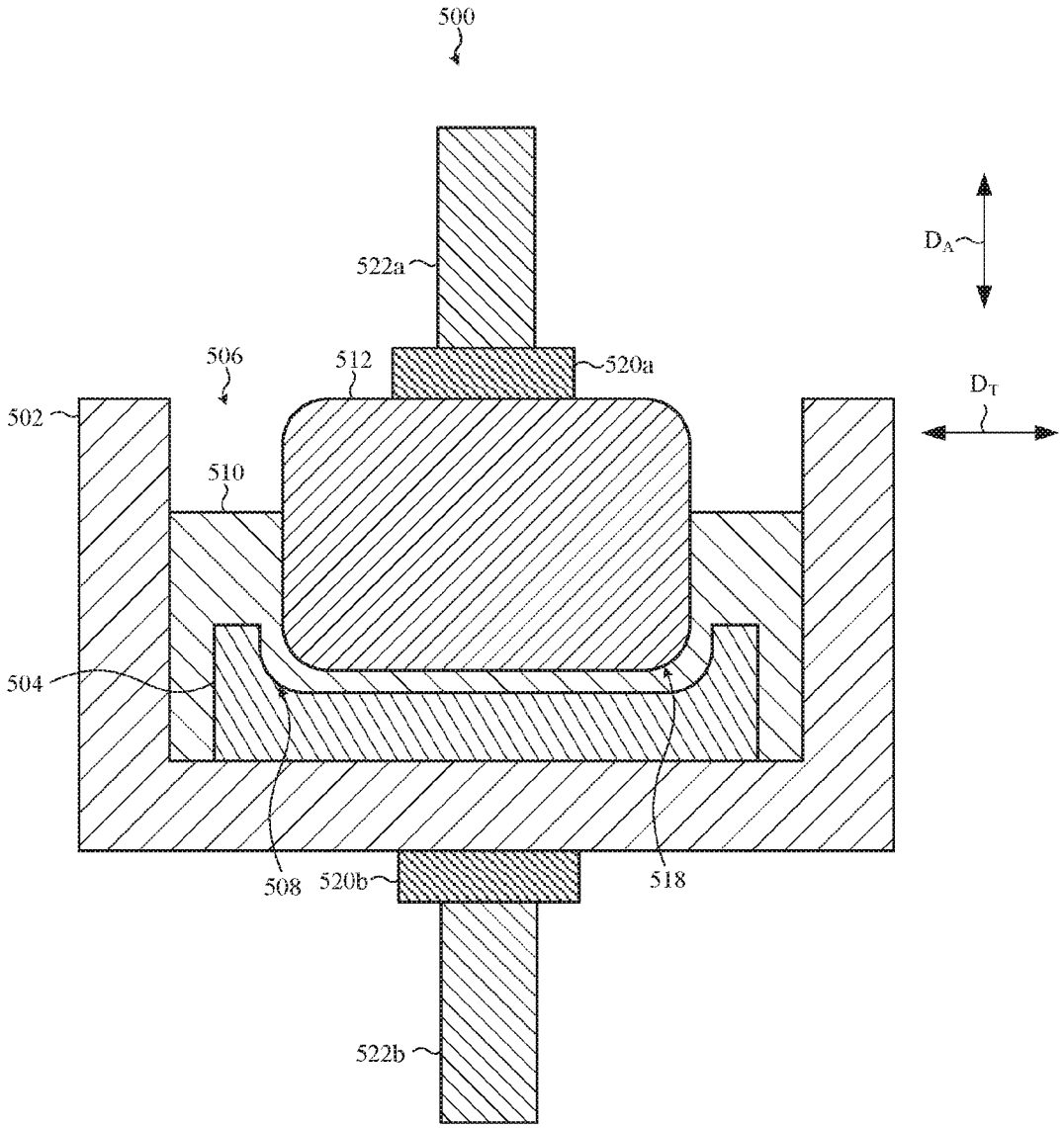
FIG. 5 shows a cross-section view of the ultrasonic polishing system and the brittle component taken along line 2-2 of FIG. 1, according to further embodiments.

In another non-limiting example shown in FIG. 5, polishing system 500 includes two distinct ultrasonic motion generators 520*a*, 520*b* and two distinct gantries 522*a*, 522*b*. As shown in FIG. 5, first ultrasonic driver 520*a* and first gantry 522*a* are coupled to polishing head 512, and second ultrasonic driver 520*b* and second gantry 522*b* are coupled to housing 502. Ultrasonic motion generators 520*a*, 520*b* can pulse and/or ultrasonically move polishing head 512 and/or housing 502, and gantries 522*a*, 522*b* can move polishing head 512 and/or housing 502 in any combination of directions (e.g., axial or transversal) to polish brittle component 504. In non-limiting example, first gantry 522*a* can move polishing head 512 in an axial direction ($D_A$), or second gantry 522*b* can move housing 502 in the axial direction ($D_A$). In another non-limiting example, first gantry 522*a* can move polishing head 512 in the axial direction ($D_A$), and second gantry 522*b* can move housing 502 in the axial direction ($D_A$), such that both polishing head 512 and housing 502 are capable of moving in the axial direction ($D_A$). In conjunction with, or separate from, the non-limiting examples above, first gantry 522*a* can also move polishing head 512 in a transversal direction ($D_T$), and/or second gantry 522*b* can move housing 502 in the transversal direction ($D_T$) to aid in polishing non-planar feature 508 of brittle component 504.

Figure 6:
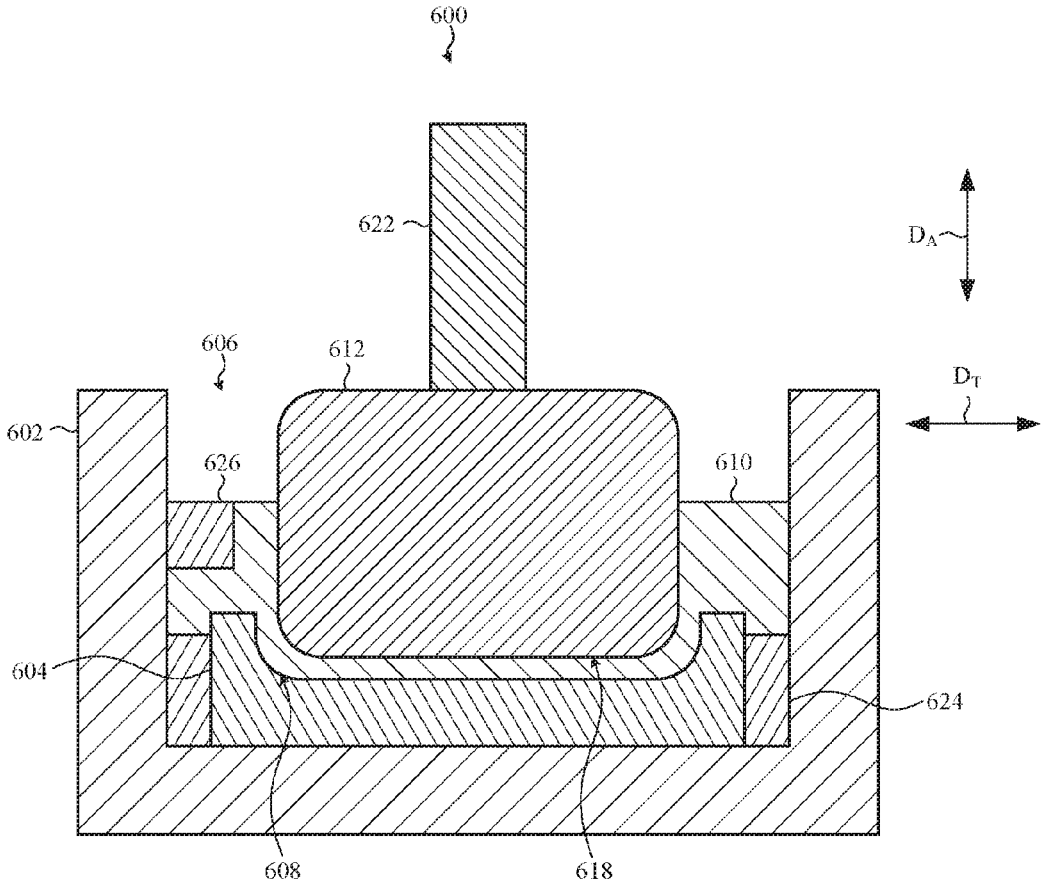
FIG. 6 shows a cross-section view of the ultrasonic polishing system and brittle component taken along line 2-2 of FIG. 1, according to embodiments.

As shown in FIG. 6, polishing system 600 can include additional features and/or components to aid in polishing non-planar feature 608 of brittle component 604. Ultrasonic driver of polishing system 600 is omitted from FIG. 6 for clarity. Polishing system 600 includes insert 624 positioned in housing 602. Insert 624 is positioned within housing 602 and substantially surrounds brittle component 604. In a non-limiting example, insert 624 is formed between brittle component 604 and housing 602 to secure brittle component 604 within housing 602, and/or prevent brittle component 604 from moving during the polishing process. By preventing brittle component 604 from moving within housing 602, insert 624 may aid in polishing non-planar feature 608 of brittle component 604 to a desired finish.

Polishing system 600, as shown in FIG. 6, also includes media flow system 626. Media flow system 626 is positioned within housing 602 adjacent brittle component 604 and/or polishing head 612. As shown in FIG. 6, media flow system 626 is at least partially submerged in, and in fluid communication with, abrasive slurry 610. Media flow system 626 may aid in the movement and/or continuous recirculation of abrasive slurry 610 within housing 602 during the polishing process. In a non-limiting example, media flow system 626 may be configured as a pump that may continuously intake abrasive slurry 610 disposed within housing 602 and flow the abrasive slurry 610 toward non-planar feature 608 of brittle component 604. As discussed herein, the flowing of abrasive slurry 610 over non-planar feature 608 of brittle component 604 results in the polishing of non-planar feature 608. The flowing or moving of abrasive slurry 610 achieved by the displacing and ultrasonic movement of polishing head 612 and/or housing 602, as discussed herein with respect to FIGS. 1-2B, may be supplemented by media flow system 626 to improve polishing quality and/or polishing time.

Figure 7:
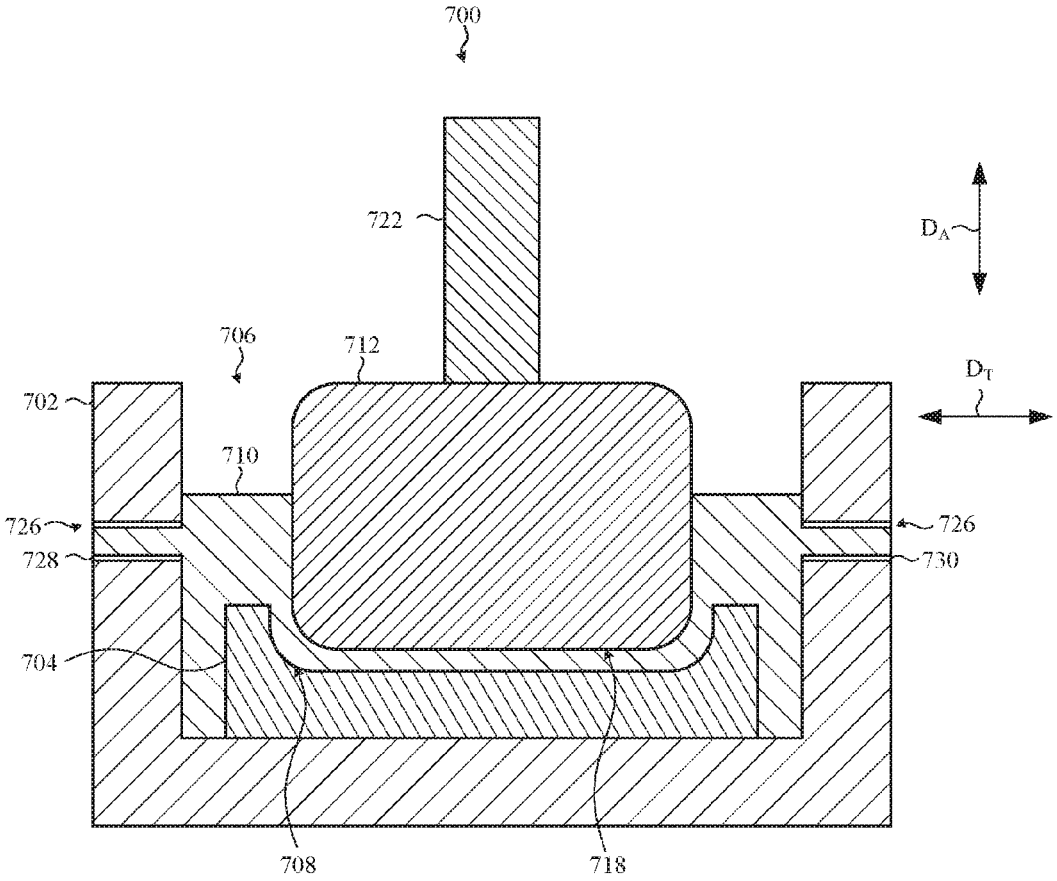
FIG. 7 shows a cross-section view of the ultrasonic polishing system and brittle component taken along line 2-2 of FIG. 1, according to further embodiments. The ultrasonic polishing system includes a media flow system.

FIG. 7 shows another, non-limiting example of media flow system 726 implemented within polishing system 700. Similar to FIG. 6, ultrasonic driver of polishing system 700 is omitted from FIG. 7 for clarity. As shown in FIG. 7, media flow system 726 includes an inlet 728 formed in and/or through a portion of housing 702, and a corresponding outlet 730 formed in a distinct portion of housing 702. In the non-limiting example, abrasive slurry 710 is continuously supplied within housing 702 via inlet 728 to substantially surround brittle component 704 during the polishing process. Simultaneously, abrasive slurry 710 already contained within housing 702 is removed via outlet 730. As a result of implementing media flow system 726 shown in FIG. 7, abrasive slurry 710 is continuously supplied to housing 702 via inlet 728 to flow over and/or polish non-planar feature 708 of brittle component 704, and is subsequently removed from housing 702 via outlet 730 to make room within housing 702 for newly supplied abrasive slurry 710. This is distinct from the polishing systems discussed herein with respect to FIGS. 1-6, which may have a fixed amount of abrasive slurry supplied to the housing and used to polish the brittle component.

Figure 8:
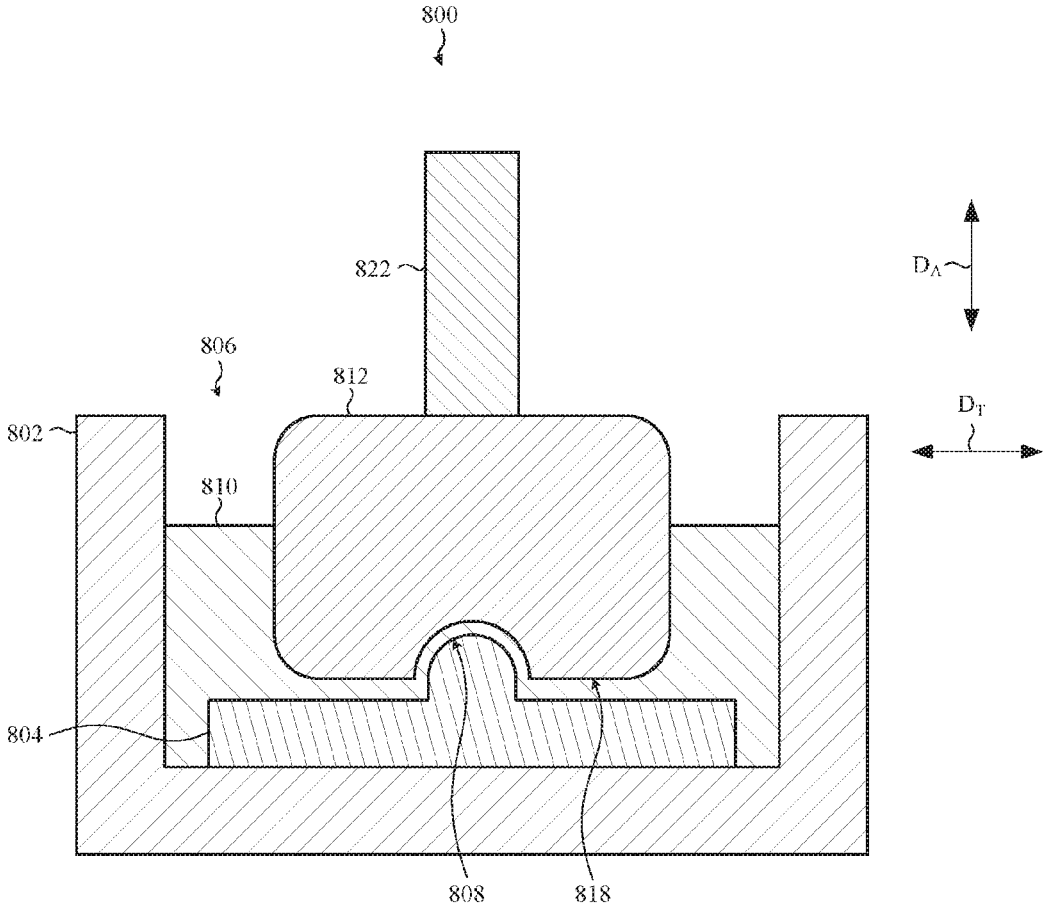
FIG. 8 shows a cross-section view of the ultrasonic polishing system and the brittle component taken along line 2-2 of FIG. 1, according to further embodiments. The brittle component includes a protrusion.
Figure 9:
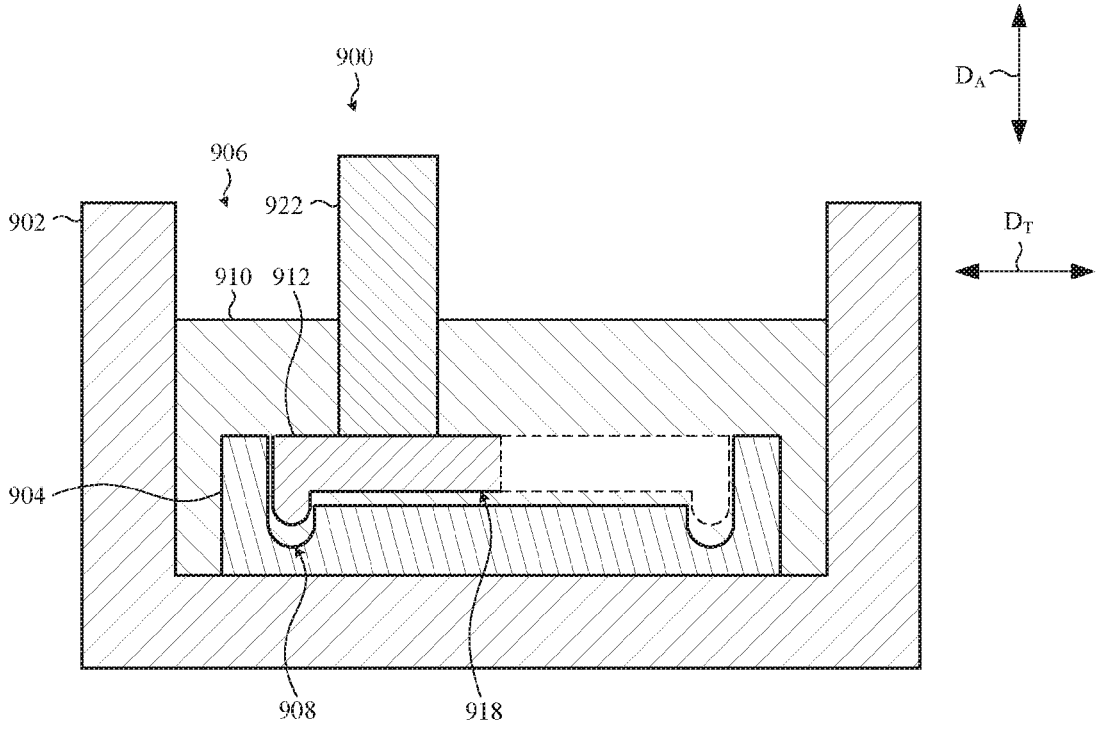
FIG. 9 shows a cross-section view of the ultrasonic polishing system and the brittle component taken along line 2-2 of FIG. 1, according to further embodiments. The brittle component includes a groove.
Figure 10:
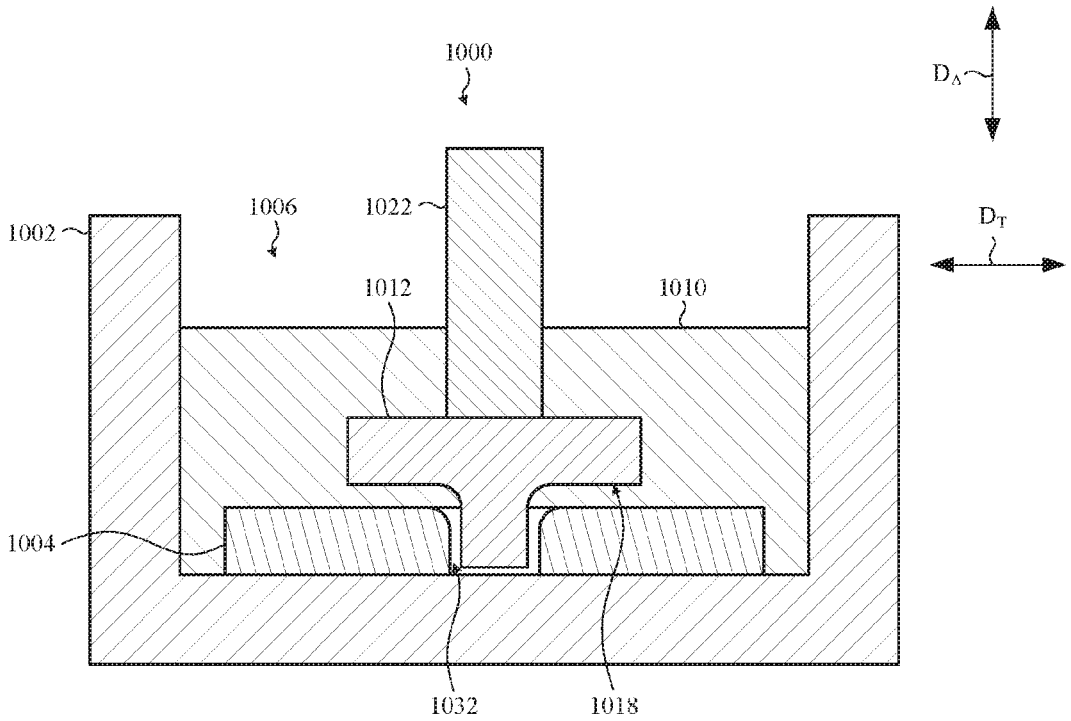
FIG. 10 shows a cross-section view of the ultrasonic polishing system and the brittle component taken along line 2-2 of FIG. 1, according to further embodiments. The brittle component includes an aperture.

FIGS. 8-10 show additional, non-limiting examples of a polishing system configured to polish brittle components having various non-planar features. The ultrasonic drivers of the polishing systems shown in FIGS. 8-10 are omitted for clarity. Additionally, it is understood that similarly numbered and/or named components may function in a substantially similar fashion. Redundant explanation of these components have been omitted for clarity.

FIG. 8 shows non-planar feature 808 as a protrusion extending from a portion of brittle component 804. Polishing head 812 of polishing system 800 includes exterior contact surface 818 having a surface shape that corresponds to the shape of the protrusion forming non-planar feature 808. In the non-limiting example shown in FIG. 8, polishing head 812 includes a recess having a shape corresponding to the shape of the protrusion.

FIG. 9 shows non-planar feature 908 as a groove formed partially through brittle component 904. Polishing head 912 of polishing system 900 therefore includes exterior contact surface 918 having a surface shape that corresponds to the shape of the groove forming non-planar feature 908. In the non-limiting example shown in FIG. 9, polishing head 912 includes a projection having a shape corresponding to the shape of the groove. Polishing head 912 having the corresponding surface shape for non-planar feature 908 can be configured to polish only a portion of brittle component 904, or alternatively, polishing head 912 can be rotated by gantry 922 to polish all portions of brittle component 904. These configurations are shown by the phantom lines in FIG. 9, which depict either a newly configured polishing head 912 is positioned adjacent brittle component 904 to polish non-planar feature 908, or alternatively, that polishing head 912 is rotated to be used to polish all portions of brittle component 904.

FIG. 10 shows a unique non-planar feature as an aperture 1032 formed and/or extending through brittle component 1004. As a result of aperture 1032 being formed through brittle component 1004, polishing head 1012 of polishing system 1000 includes a T-shaped structure having a shape corresponding to aperture 1032. Specifically, and as shown in FIG. 10 and discussed herein with respect to the polishing process, polishing head 1012 includes a T-shaped structure or configuration having a shape corresponding to aperture 1032 and a portion of brittle component 1004 surrounding aperture 1032.

Figure 11:
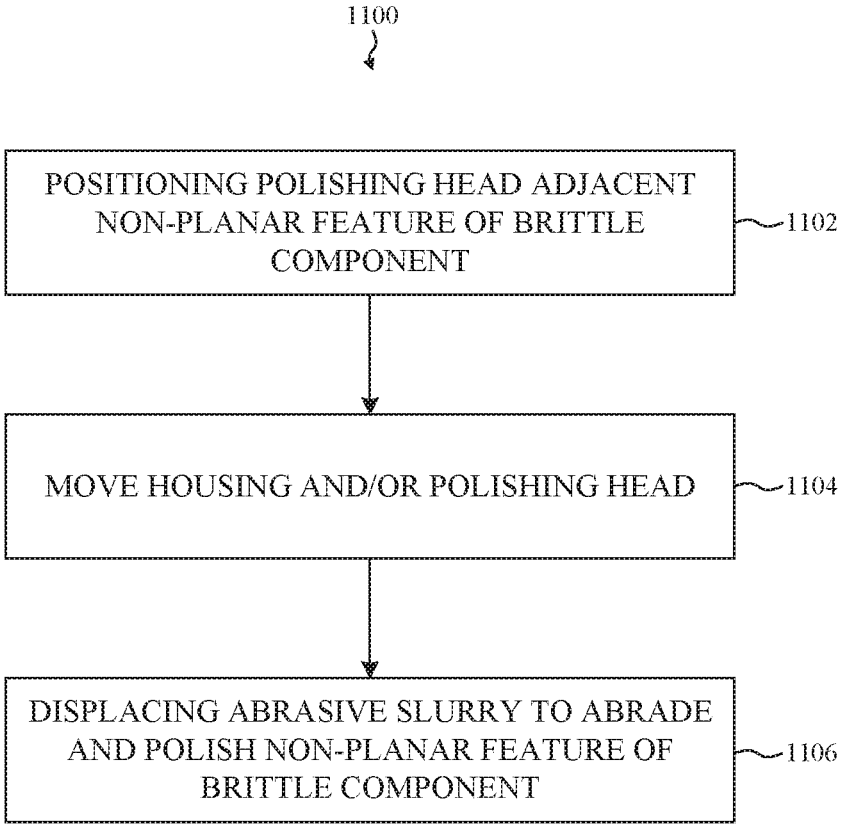
FIG. 11 shows a flow chart of an example process for polishing a non-planar feature of a brittle component utilized in an electronic device, according to embodiments.

FIG. 11 depicts an example process 1100 for polishing a non-planar feature of a brittle component utilized in an electronic device. This process may be used with one of various embodiments as discussed above with respect to FIGS. 1-10.

In operation 1102, a polishing head of a polishing system is positioned adjacent a non-planar feature of a brittle component. Specifically, the brittle component can be positioned within a housing of the polishing system and the polishing head can be positioned within the housing adjacent the non-planar feature formed in the brittle component. The polishing head includes an external contact surface that has a surface shape that corresponds to the shape of the non-planar feature of the brittle material to be polished.

The brittle component is positioned within the housing of the polishing system and is at least partially submerged in an abrasive slurry disposed within the housing. Additionally, the brittle component positioned within the housing can also be secured to the housing by positioning an insert within the housing, where the insert substantially surrounds the brittle component and is positioned between the brittle component and the housing.

In operation 1104, the housing and/or the polishing head are moved. The housing and/or polishing head are moved at an ultrasonic frequency. Additionally, the housing and/or the polishing head are moved in a first direction and/or a second direction, perpendicular to the first direction. The first direction can be toward and/or away from the brittle component. The moving of the housing and/or the polishing head can include repeatedly displacing the polishing head and/or the housing toward and away from (e.g., first direction) the non-planar feature of the brittle component. Additionally, displacing the polishing head and/or the housing can include moving the polishing head and/or the housing to allow the polishing head to contact the non-planar feature of the brittle component and forming a gap between the polishing head and the non-planar feature of the brittle component. The gap formed between the polishing head and the non-planar feature of the brittle component can be dependent on characteristics of the abrasive slurry disposed in the housing of the polishing system. In a non-limiting example, the gap can equal approximately 150% of a grain size of a solid abrasive material forming the abrasive slurry.

In operation 1106, the abrasive slurry is displaced within the housing. Specifically, in response to moving the polishing head and/or housing in operation 1104, the abrasive slurry is displaced in operation 1106 to abrade and/or polish the non-planar feature of the brittle component. The abrasive slurry moves and/or is displaced between the polishing head and the brittle component, and passes over the non-planar feature of the brittle component. The movement of the housing and/or the polishing head aid in moving the abrasive slurry positioned within the housing over the non-planar feature of the brittle component. Additionally, the displacing of the abrasive slurry includes continuously recirculating the abrasive slurry over the non-planar feature. As the abrasive slurry continuously or repeatedly passes over the brittle component, and specifically the non-planar feature, the abrasive slurry abrades and/or polishes the non-planar feature.

Figure 12:
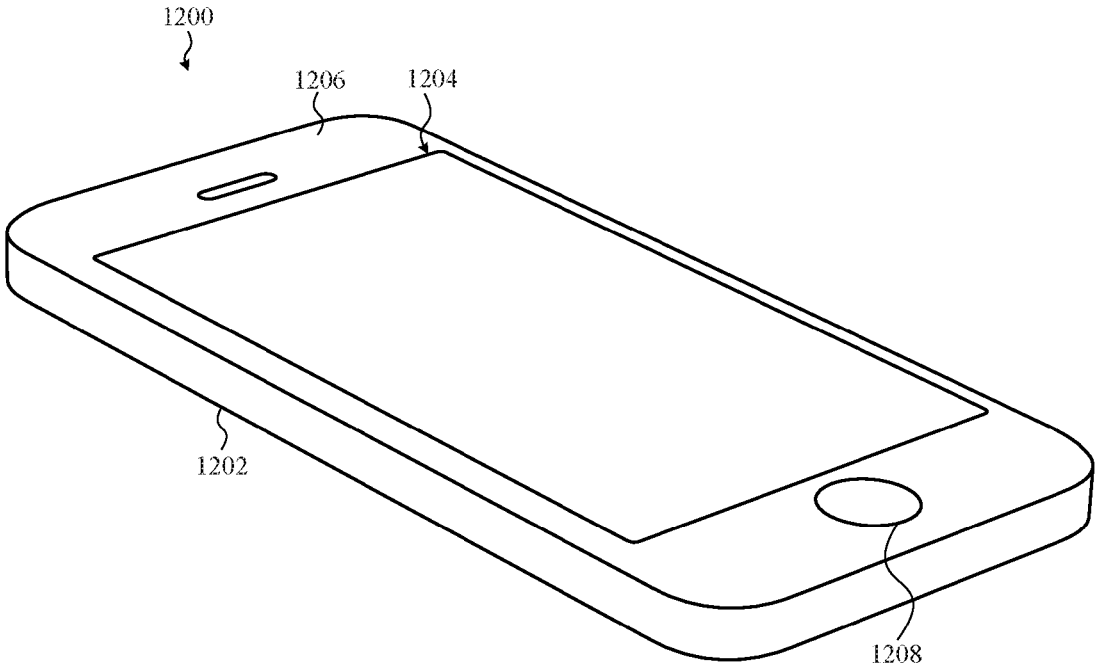
FIG. 12 shows an electronic device that utilizes the brittle component as discussed with respect to FIGS. 1-11, according to embodiments.

FIG. 12 shows an isometric view of an electronic device 1200. As discussed herein, electronic device 1200 may include various components that may utilize the polished, brittle component having the non-planar feature discussed herein with respect to FIGS. 1-7. As shown in FIG. 9, electronic device 1200 is implemented as a smart telephone. Other embodiments can implement electronic device 1200 differently, for example, as a laptop or desktop computer, a tablet computing device, a gaming device, a display, a digital music player, a wearable computing device or display, a health monitoring device, and so on.

Electronic device 1200 includes a housing 1202 at least partially surrounding a display module 1204, a cover glass 1206 substantially covering display module 1204 and one or more buttons 1208 or input devices. Housing 1202 can form an outer surface or partial outer surface and protective case for the internal components of the electronic device 1200, and may at least partially surround display module 1204 positioned within an internal cavity formed by housing 1202. Housing 1202 can be formed of one or more components operably connected together, such as a front piece and a back piece (not shown). Alternatively, housing 1202 can be formed of a single piece operably connected to display module 1204. Housing 1202 may be formed from any suitable material that may house and/or may protect the internal components of electronic device 1200, including display module 1204. In non-limiting examples, housing 1202 may be formed from glass, or sapphire.

Display module 1204 may be substantially surrounded by housing 1202 and/or may be positioned within an internal cavity formed by housing 1202. Display module 1204 can be implemented with any suitable technology, including, but not limited to, a multi-touch sensing touchscreen that uses liquid crystal display (LCD) technology, light emitting diode (LED) technology, organic light-emitting display (OLED) technology, organic electroluminescence (OEL) technology, or another type of display technology. Display module 1204 may be positioned within an internal cavity of housing 1202 and may be substantially protected on almost all sides by housing 1202.

Cover glass 1206 may be formed integral with and/or may be coupled to housing 1202 to substantially cover and protect display module 1204. Cover glass 1206 may cover at least a portion of the front surface of electronic device 1200. When a user interacts with display module 1204 of electronic device 1200, the user may touch or contact cover glass 1206. Cover glass 1206 may be formed from any suitable material that be substantially transparent and may protect display module 1204. In non-limiting examples, cover glass 1206 may be formed from glass or sapphire.

Button 1208 can take the form of a home button, which may be a mechanical button, a soft button (e.g., a button that does not physically move but still accepts inputs), an icon or image on a display, and so on. Further, in some embodiments, button 1208 can be integrated as part of cover glass 1206 of the electronic device 1200. Button 1208, like housing 1202, may be formed from any suitable material that may withstand an undesirable drop event that may occur with electronic device 1200. In non-limiting examples, button 1208 may be formed from glass, or sapphire.

Electronic device 1200 may also utilize the polished, brittle components having the non-planar feature to form at least a portion of an external surface of housing 1202. That is, a variety of exposed and/or external components of electronic device 1200 may include the polished brittle components. In a non-limiting example shown in FIG. 9, the polished, brittle components may be utilized to form housing 1202. In another non-limiting example, the polished, brittle components can form cover glass 1206. In a further non-limiting example, the polished, brittle components can also form button 1208.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. An ultrasonic polishing system for polishing a non-planar feature formed in a brittle component, the system comprising:

an ultrasonic driver;

a polishing head operatively coupled to the ultrasonic driver and having a surface shape that corresponds to a shape of the non-planar feature formed in the brittle component; and an abrasive slurry configured to be disposed between the non-planar feature of the brittle component and the polishing head; wherein the ultrasonic driver is configured to displace the polishing head toward and away from the non-planar feature formed in the brittle component.

2. The ultrasonic polishing system of claim 1, wherein the abrasive slurry comprises a solid abrasive material suspended in a liquid, the solid abrasive material having a hardness greater than the brittle component.

3. The ultrasonic polishing system of claim 2, wherein a gap formed between the polishing head and the non-planar feature of the brittle component is greater than a grain size of the solid abrasive material.

4. The ultrasonic polishing system of claim 3, wherein the polishing head is displaced to:

contact the non-planar feature of the brittle component; and to form the gap between the polishing head and the non-planar feature of the brittle component that is approximately 150% of the grain size of the solid abrasive material.

5. The ultrasonic polishing system of claim 1, further comprising an actuating gantry coupled to the ultrasonic driver and configured to move the polishing head in at least one of:

a first direction; and a second direction, perpendicular to the first direction.

6. The ultrasonic polishing system of claim 1, wherein the surface shape of the polishing head comprises at least one of:

a substantially non-linear transition portion;

a groove;

a protrusion; or an aperture.

7. The ultrasonic polishing system of claim 1, further comprising an insert surrounding the brittle component and configured to substantially secure the brittle component while the ultrasonic driver displaces the polishing head.

8. The ultrasonic polishing system of claim 1 further comprising a media flow system in fluid communication with the abrasive slurry, the media flow system configured to recirculate the abrasive slurry.

9. A method for polishing a non-planar feature of a brittle component, the method comprising:

positioning a polishing head adjacent the non-planar feature of the brittle component, the brittle component at least partially submerged in an abrasive slurry disposed within a housing;

moving, at an ultrasonic frequency, at least one of the housing or the polishing head in at least one of:

a first direction; or a second direction, perpendicular to the first direction; and in response to moving at least one of the housing of the polishing head, displacing the abrasive slurry to abrade and polish the non-planar feature of the brittle component; wherein the polishing head comprises a surface shape that corresponds to a shape of the non-planar feature of the brittle component.

10. The method of claim 9, wherein moving the polishing head comprises repeatedly displacing the polishing head toward and away from the non-planar feature of the brittle component.

11. The method of claim 10, wherein displacing the polishing head comprises moving the polishing head to:

contact the non-planar feature of the brittle component; and form a gap between the polishing head and the non-planar feature of the brittle component, the gap equal to approximately 150% of a grain size of a solid abrasive material of the abrasive slurry.

12. The method of claim 9, wherein moving the housing comprises repeatedly displacing the brittle component toward and away from the polishing head.

13. The method of claim 9, wherein displacing the abrasive slurry to abrade and polish the non-planar feature of the brittle component comprises continuously recirculating the abrasive slurry over the non-planar feature.

14. The method of claim 9, further comprising securing the brittle component within the housing prior to positioning the polishing head adjacent the non-planar feature of the brittle component.

15. An ultrasonic polishing system comprising:

a housing for receiving a brittle component comprising a non-planar feature;

a polishing head positioned within the housing, the polishing head having a surface shape that corresponds to a shape of the non-planar feature formed in the brittle component;

an abrasive slurry positioned within the housing, the abrasive slurry comprising a solid abrasive material suspended in a liquid; and an ultrasonic driver configured to move at least one of the housing or the polishing head at an ultrasonic frequency to polish the non-planar feature of the brittle component using the abrasive slurry.

16. The ultrasonic polishing system of claim 15, wherein the polishing head comprises a projection having a shape that corresponds to a shape of a groove formed in the brittle component.

17. The ultrasonic polishing system of claim 15, wherein the polishing head comprises a recess having a shape that corresponds to a shape of a protrusion formed in the brittle component.

18. The ultrasonic polishing system of claim 15, wherein the polishing head comprises a T-shaped structure having a shape corresponding to a shape of an aperture formed in the brittle component and a portion of the brittle component surrounding the aperture.

19. The ultrasonic polishing system of claim 15, wherein a gap formed between the polishing head and the non-planar feature of the brittle component is greater than a grain size of the solid abrasive material.

20. The ultrasonic polishing system of claim 15, wherein the solid abrasive material has a hardness greater than the brittle component.

* * * * *